US009067413B2

(12) United States Patent
Koseki

(10) Patent No.: US 9,067,413 B2
(45) Date of Patent: Jun. 30, 2015

(54) LIQUID JET HEAD AND LIQUID JET APPARATUS

(71) Applicant: SII Printek Inc., Chiba (JP)

(72) Inventor: Osamu Koseki, Chiba (JP)

(73) Assignee: SII PRINTEK INC. (JP)

( * ) Notice: Subject to any disclaimer, the term of this patent is extended or adjusted under 35 U.S.C. 154(b) by 6 days.

(21) Appl. No.: 13/737,016

(22) Filed: Jan. 9, 2013

(65) Prior Publication Data

US 2013/0187989 A1 Jul. 25, 2013

(30) Foreign Application Priority Data

Jan. 25, 2012 (JP) ..... 2012-012995

(51) Int. Cl.
*B41J 2/015* (2006.01)
*B41J 2/14* (2006.01)

(52) U.S. Cl.
CPC ..... *B41J 2/14201* (2013.01); *B41J 2/14209* (2013.01); *B41J 2002/14403* (2013.01); *B41J 2202/12* (2013.01); *B41J 2202/20* (2013.01); *B41J 2002/14491* (2013.01)

(58) Field of Classification Search
None
See application file for complete search history.

(56) References Cited

U.S. PATENT DOCUMENTS

2002/0071009 A1* 6/2002 Yamada et al. ..... 347/71
2010/0289857 A1* 11/2010 Bennett ..... 347/89

FOREIGN PATENT DOCUMENTS

| | | |
|---|---|---|
| JP | 10146974 | 6/1998 |
| JP | 2005193465 | 7/2005 |
| JP | 2008207350 | 9/2008 |
| JP | 2010017901 | 1/2010 |

OTHER PUBLICATIONS

British IPO Search Report mailed Jun. 19, 2013 issued in GB Appln. No. GB1301331.3.

* cited by examiner

*Primary Examiner* — Erica Lin
(74) *Attorney, Agent, or Firm* — Adams & Wilks

(57) ABSTRACT

A liquid jet head is provided with laminated head chips forming a laminated structure. Each of the head chips has an actuator portion and a nozzle plate bonded to a first end face of the actuator portion. The actuator portion of each head chip has a filter, a first liquid chamber communicating to a downstream side of the filter, a channel communicating to the first liquid chamber for inducing pressure on liquid therein, and an electrode terminal for transmitting a drive signal to the channel. The nozzle plate has a nozzle communicating to the channel of the actuator portion. The surfaces of the nozzle plates of the respective head chips are flush with one another.

5 Claims, 7 Drawing Sheets

LIQUID JET HEAD AND LIQUID JET APPARATUS

BACKGROUND OF THE INVENTION

1. Field of the Invention

The present invention relates to a liquid jet head for ejecting liquid from a nozzle to record characters or graphics on a recording medium, or to form a functional thin film thereon, and a liquid jet apparatus using the liquid jet head.

2. Description of the Related Art

In recent years, there has been used an ink-jet type liquid jet head for ejecting ink droplets on recording paper or the like to record characters or graphics thereon, or for ejecting a liquid material on a surface of an element substrate to form a functional thin film thereon. In such a liquid jet head, ink or a liquid material is supplied from a liquid tank via a supply tube to the liquid jet head, and ink or a liquid material filled into a channel is ejected from a nozzle which communicates to the channel. When liquid is ejected, the liquid jet head or a recording medium is moved to record characters or graphics, or to form a functional thin film in a predetermined shape.

Conventionally, for the purpose of miniaturizing a liquid jet head and of achieving higher density recording, an ink jet head 100 has been proposed in which actuator units are multilayered and integrally formed. FIG. 12 is a schematic view of an ink jet head described in Japanese Patent Application Laid-open No. Hei 10-146974 (FIG. 1 of Japanese Patent Application Laid-open No. Hei 10-146974). In the ink jet head 100, eight actuator units 120 to 190 each including a cover plate 121 and a base plate 122 are laminated, and one nozzle plate 111 is bonded to end faces thereof. The units have basically the same structure. Specifically, a plurality of ink chambers 124 in parallel with one another are formed in a surface of each base plate 122. Each ink chamber 124 is sandwiched between two piezoelectric elements, and openings in an upper surface of the ink chambers 124 are covered by the cover plate 121.

A cover plate 131 at a laminated portion includes a projecting portion 131*a* on a side opposite to the nozzle plate 111. An output side electrode 128 and an input side electrode 126 are formed and a driver IC chip 125 is provided on the projecting portion 131*a*. A flexible substrate (hereinafter referred to as FPC) 127 is connected to the projecting portion 131*a* to be electrically conductive to the input side electrode 126. A plurality of nozzles 112 communicating to the ink chambers 124, respectively, in the base plates 122 are formed in the nozzle plate 111. A control signal is input to the driver IC chip 125 in each actuator unit through the FPC 127 and the input side electrode 126, and a drive signal is supplied by the driver IC chip 125 to the piezoelectric element via the output side electrode 128 and a drive electrode 123 formed on the end face of the base plate 122 on the nozzle plate 111 side to drive the ink chamber 124. Pressure is applied to ink filled into the ink chamber 124 in accordance with a drive signal to eject an ink droplet from the nozzle 112.

FIG. 13 is a schematic sectional view of a liquid jet head 220 described in Japanese Patent Application Laid-open No. 2008-207350. In the liquid jet head 220, head chip bodies 227 each of which is formed by laminating an actuator substrate 225 and a cover plate substrate 226 are laminated in four layers, and one nozzle plate 223 is bonded to the other edge sides 221*b* thereof. One edge side 221 A of the actuator substrate 225 in one layer in the head chip bodies 227 laminated in four layers protrudes from the one edge side 221 A of the actuator substrate 225 in the layer immediately thereon.

An FPC 213 is connected to a substrate connection surface 228 which is an upper surface of a protruding portion of each actuator substrate 225.

A plurality of channels 229 are formed in parallel with one another at substantially the same place in a P direction in each actuator substrate 225. Each channel 229 is sandwiched between side walls 229*b*, and an electrode 231 is formed on each side wall 229*b*. The electrode 231 is provided so as to extend to the substrate connection surface 228, and is electrically conductive to wiring (not shown) formed on the FPC 213 bonded to the substrate connection surface 228. A plurality of nozzles 223*a* are formed in the nozzle plate 223, and the plurality of nozzles 223*a* communicate to the plurality of channels 229, respectively, in each actuator substrate 225. In the cover plate substrate 226, there are formed an ink chamber 232 communicating to the respective channels 229 and ink supply holes 234 having one ends open to the ink chamber 232 and the other ends communicating with the ink chamber 232 in the head chip body 227 in the layer immediately thereunder. Therefore, ink supplied to the ink chamber 232 in the head chip body 227 in the uppermost layer is supplied to the respective channels 229 in the head chip body 227 in the uppermost layer and to the ink chambers 232 in the head chip bodies 227 in lower layers, and thus, is supplied to the channels 229 in all the head chip bodies 227.

In the ink jet head 100 disclosed in Japanese Patent Application Laid-open No. Hei 10-146974, a drive signal supplied to an ink chamber 124 in the actuator unit 120 in an upper layer is supplied from the driver IC chip 125 provided in the actuator unit 130 in the layer immediately thereunder. Further, one nozzle plate 111 is used. Therefore, the quality of the ink jet head 100 can be determined by a trial run only after the actuator units 120 to 190 in all the layers are laminated and the assembly is completed.

Further, in the ink jet head 100 disclosed in Japanese Patent Application Laid-open No. Hei 10-146974, when a conventionally used step of press-bonding the FPC 127 from the top side of FIG. 12 to the cover plate 131 for connection is reviewed, it is difficult to connect the FPCs 127 to the respective layers after the actuator units 120 to 190 in the respective layers are laminated. Therefore, the actuator units 120 to 190 to each of which the FPC 127 is connected in advance need to be prepared, and the actuator units 120 to 190 to each of which the FPC 127 is bonded need to be laminated in sequence. In that case, it is difficult to bond the actuator units 120 to 190 so that the end faces thereof on the nozzle plate 111 side are aligned to be flush with one another. The drive electrodes 123 are provided on the end faces of the actuator units 120 to 190 on the nozzle plate 111 side, and thus, after the actuator units 120 to 190 are bonded together, it is impossible to grind the end faces thereof on the nozzle plate 111 side to shape the end faces to be flush with one another. Further, it is necessary to form a large number of nozzles 112 in the one nozzle plate 111 and to accurately align the nozzles 112 with the ink chambers 124 in the multilayered actuator units 120 to 190 formed by lamination, which requires highly developed assembly operation.

In the liquid jet head 220 disclosed in Japanese Patent Application Laid-open No. 2008-207350, after the liquid jet heads 220 are laminated, it is possible to connect the FPC 213 to the one edge side 221 A of each head chip body 227. However, after the head chip bodies 227 are laminated and bonded together, the one nozzle plate 223 is bonded to the laminate, and thus, similarly to the case of the above-mentioned ink jet head 100 disclosed in Japanese Patent Application Laid-open No. Hei 10-146974, it is necessary to accurately align a large number of nozzles 223*a* with a large number of channels 229, which requires highly developed assembly operation. Further, similarly to the case of Japanese Patent Application Laid-open No. Hei 10-146974, the quality can be determined by a trial run only after the assembly is completed.

SUMMARY OF THE INVENTION

The present invention has been made in view of the above-mentioned problems, and an object of the present invention is to provide a liquid jet head which is easy to fabricate and in which only head chips whose quality has been determined by a trial run can be assembled.

According to an exemplary embodiment of the present invention, there is provided a liquid jet head, including a plurality of head chips each including: an actuator portion including: a filter; a first liquid chamber communicating to a downstream side of the filter; a channel communicating to the first liquid chamber, for inducing pressure on liquid therein; and an electrode terminal for transmitting a drive signal to the channel; and a nozzle plate which is bonded to a first end face of the actuator portion and which includes a nozzle communicating to the channel, in which the plurality of head chips are laminated so that surfaces of the nozzle plates are flush with one another.

In the liquid jet head, the actuator portion includes a communication path, and the communication path in the actuator portion in an upper layer communicates to an upstream side of the filter and the communication path of the actuator portion in a lower layer.

The liquid jet head further includes an upper end flow path member which is provided on the head chip in an uppermost layer and which includes a first supply path communicating to the upstream side of the filter and the communication path.

The liquid jet head further includes a lower end flow path member which is provided under the head chip in a lowermost layer and which includes a first discharge path communicating to the communication path.

In the liquid jet head, a plurality of the channels are arranged to form a channel row, the first liquid chamber communicates to the plurality of the channels forming the channel row, and the communication path is provided in the vicinity of an end portion of the first liquid chamber in a direction of arrangement of the plurality of the channels.

In the liquid jet head, the communication path includes a first communication path provided in the vicinity of one end portion and a second communication path provided in the vicinity of another end portion of the first liquid chamber in the direction of arrangement of the plurality of the channels.

In the liquid jet head, the first communication path in the head chip in an upper layer communicates to the first communication path and the upstream side of the filter of the head chip in a lower layer, and the second communication path in the head chip in the upper layer communicates to the second communication path and the upstream side of the filter of the head chip in the lower layer.

The liquid jet head further includes an upper end flow path member which is provided on the head chip in an uppermost layer and which includes a first supply path communicating to the upstream side of the filter and the first communication path.

The liquid jet head further includes a lower end flow path member which is provided under the head chip in a lowermost layer and which includes a first discharge path communicating to the second communication path.

In the liquid jet head, the upper end flow path member includes a first discharge path communicating to the second communication path.

In the liquid jet head, the communication path communicates to a second liquid chamber communicating to the upstream side of the filter.

In the liquid jet head, the actuator portion includes a communication path, and the liquid jet head further includes a right end flow path member which is provided along a third end face of the actuator portion and which includes a second supply path communicating to the upstream side of the filter and the communication path.

In the liquid jet head, the communication path includes a third communication path communicating to the second supply path and a fourth communication path communicating to the upstream side of the filter, and the liquid jet head further includes a left end flow path member which is provided along a fourth end face corresponding to the third end face of the actuator portion and which includes a second discharge path communicating to the fourth communication path.

In the liquid jet head, the actuator portion includes a second liquid chamber communicating to the upstream side of the filter.

In the liquid jet head, the head chip in an upper layer includes a recessed portion in a region corresponding to the filter of the head chip in a lower layer.

In the liquid jet head, the electrode terminal is provided on a second end face side which is opposite to the first end face of the actuator portion.

In the liquid jet head, the head chip in an upper layer and the head chip in a lower layer are bonded together via a rubber sealing material.

In the liquid jet head, the head chip includes a bonding groove for introducing an adhesive, which is formed in one of an upper end face and a lower end face thereof.

In the liquid jet head, the plurality of head chips are laminated so that second end faces which are end faces opposite to the first end faces of the actuator portions are flush with one another.

In the liquid jet head, the actuator portion includes a piezoelectric substrate and a cover plate bonded to a surface of the piezoelectric substrate, the channel includes: a groove provided in the surface of the piezoelectric substrate from one end portion to a vicinity to another end portion on an opposite side of the one end portion; and the cover plate which covers an upper opening of the groove, the first liquid chamber is formed in the cover plate, the filter is provided in the cover plate on an upstream side of the first liquid chamber, the electrode terminal is provided on the surface of the piezoelectric substrate, and the first end face includes an end face at which the piezoelectric substrate and the cover plate are flush with each other.

According to another exemplary embodiment of the present invention, there is provided a liquid jet apparatus, including: the liquid jet head having any one of the configurations described above; a moving mechanism for reciprocating the liquid jet head; a liquid supply tube for supplying liquid to the liquid jet head; and a liquid tank for supplying the liquid to the liquid supply tube.

The liquid jet head according to the exemplary embodiment of the present invention includes the plurality of head chips each including the actuator portion and the nozzle plate. The actuator portion includes: the filter; the first liquid chamber communicating to the downstream side of the filter; the channel communicating to the first liquid chamber for inducing pressure on liquid therein; and the electrode terminal for transmitting the drive signal to the channel. The nozzle plate includes the nozzle communicating to the channel, and is bonded to the first end face of the actuator portion. The plurality of head chips are laminated so that the surfaces of the nozzle plates are flush with one another.

By the foregoing arrangement, inspection of the respective head chips before the respective head chips are laminated and assembled is enabled. Only head chips which have passed inspection in advance can be assembled, and thus, manufacturing yield can be significantly improved to thereby reduce costs.

DETAILED DESCRIPTION OF THE PREFERRED EMBODIMENTS

Figure 1:
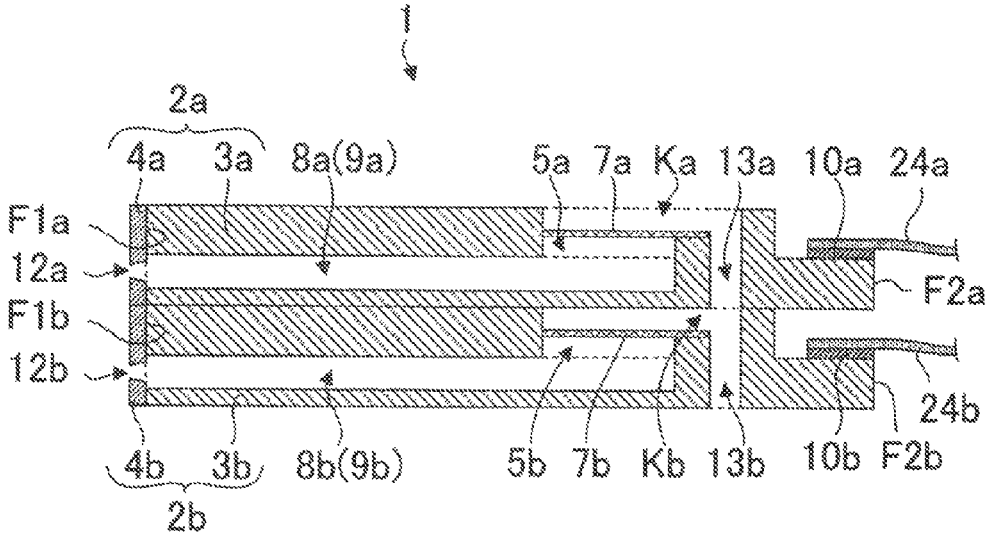
FIG. 1 is a conceptual view illustrating a basic structure of a liquid jet head according to the present invention.

FIG. 1 is a conceptual view illustrating a basic structure of a liquid jet head 1 according to the present invention. In the liquid jet head 1, a head chip 2*a* and a head chip 2*b* are laminated to form a laminated structure. The head chip 2*a* includes an actuator portion 3*a* and a nozzle plate 4*a* bonded to a first end face F1*a* of the actuator portion 3*a*. The head chip 2*b* includes an actuator portion 3*b* and a nozzle plate 4*b* bonded to a first end face F1*b* of the actuator portion 3*b*.

The actuator portion 3*a* includes a first liquid chamber 5*a* communicating to a downstream side of a filter 7*a*, a channel 8*a* communicating to the first liquid chamber 5*a* for inducing pressure on liquid therein, and an electrode terminal 10*a* for transmitting a drive signal to the channel 8*a*. The nozzle plate 4*a* includes a nozzle 12*a* formed therein for communicating to the channel 8*a*, and is bonded to the first end face F1*a*. The actuator portion 3*b* includes a first liquid chamber 5*b* communicating to a downstream side of a filter 7*b*, a channel 8*b* communicating to the first liquid chamber 5*b* for inducing pressure on liquid therein, and an electrode terminal 10*b* for transmitting a drive signal to the channel 8*b*. The nozzle plate 4*b* includes a nozzle 12*b* formed therein for communicating to the channel 8*b*, and is bonded to the first end face F1*b*. The head chip 2*a* and the head chip 2*b* are laminated under a state in which a surface of the nozzle plate 4*a* and a surface of the nozzle plate 4*b* are flush with each other. It is noted that the surfaces of the nozzle plates 4*a* and 4*b* do not need to be flush with each other as accurately as required when one nozzle plate 4 is bonded both to the first end face F1*a* of the head chip 2*a* and to the first end face F1*b* of the head chip 2*b*. A plurality of the channels 8*a* and a plurality of the channels 8*b* are formed in parallel with one another in a direction which is perpendicular to the plane of the drawing to form channel rows 9*a* and 9*b*, respectively.

When the head chip 2*a* and the head chip 2*b* have the same structure, a second end face F2*a* on a side opposite to the first end face F1*a* of the head chip 2*a* and a second end face F2*b* on a side opposite to the first end face F1*b* of the head chip 2*b* are also provided so as to be flush with each other. The electrode terminals 10*a* and 10*b* are provided on upper surfaces in vicinity of the second end faces F2*a* and F2*b*, respectively, and are connected to FPCs 24*a* and 24*b*, respectively.

Operation of the head chip 2*a* is as follows. Part of liquid supplied from an opening Ka flows via the filter 7*a* into the first liquid chamber 5*a* and is filled into the channel 8*a*. The rest of the liquid flows into a communication path 13*a*. The communication path 13*a* is open to an opening Kb of the actuator portion 3*b*. Part of the liquid is filled via the filter 7*b* into the first liquid chamber 5*b*, and the rest of the liquid flows into a communication path 13*b*. The channel 8*a* is formed so as to be sandwiched between side walls each of which is, for example, a piezoelectric element. A drive signal from the electrode terminal 10*a* is applied to these piezoelectric elements. The capacity of the channel 8*a* changes in accordance with the applied drive signal to induce pressure on liquid therein. The induced pressure causes a liquid droplet to be ejected from the nozzle 12*a*. The head chip 2*b* has a similar structure and operates similarly.

As described above, the head chip 2*a* in the upper layer and the head chip 2*b* in the lower layer have the same structure. Therefore, the two head chips 2*a* and 2*b* can be manufactured through the same manufacturing process steps. The head chips 2*a* and 2*b* include filters 7*a* and 7*b*, respectively. Therefore, a foreign matter such as dust can be prevented from entering the channels 8*a* and 8*b* during an assembly step. Further, the nozzle plates 4*a* and 4*b* are individually provided on the first end faces F1*a* and F1*b* of the actuator portions 3*a* and 3*b*, respectively, and thus, the alignment is easier than that in a case in which one nozzle plate is bonded to end faces of a plurality of actuator portions. Further, ejection inspection of the respective head chips 2*a* and 2*b* can be carried out before other head chips are laminated and bonded thereto. In other words, only the head chips 2*a* and 2*b* which have passed the ejection inspection of actually causing liquid to be ejected can be assembled. Therefore, compared with a case in which the head chips 2*a* and 2*b* are inspected after assembly, manufacturing yield can be improved to reduce costs.

As illustrated in FIG. 1, it is noted that the head chips 2*a* and 2*b* communicate to the openings Ka and Kb and include communication paths 13*a* and 13*b* for flowing liquid, respectively. The communication path 13*a* in the head chip 2*a* in the upper layer communicates to an upstream side of the filter 7*b* and with the communication path 13*b* in the head chip 2*b* in the lower layer. Therefore, liquid which flows out of the communication path 13*a* in the head chip 2*a* in the upper layer flows into the filter 7*b* and the communication path 13*b* in the head chip 2*b* in the lower layer. In this way, liquid can be supplied sequentially from the head chip 2*a* in the upper layer to the head chip 2*b* in the lower layer. Even when the head chips 2 in two or more layers are formed by lamination, it is not necessary to additionally provide a flow path member between the layers.

Figure 2:
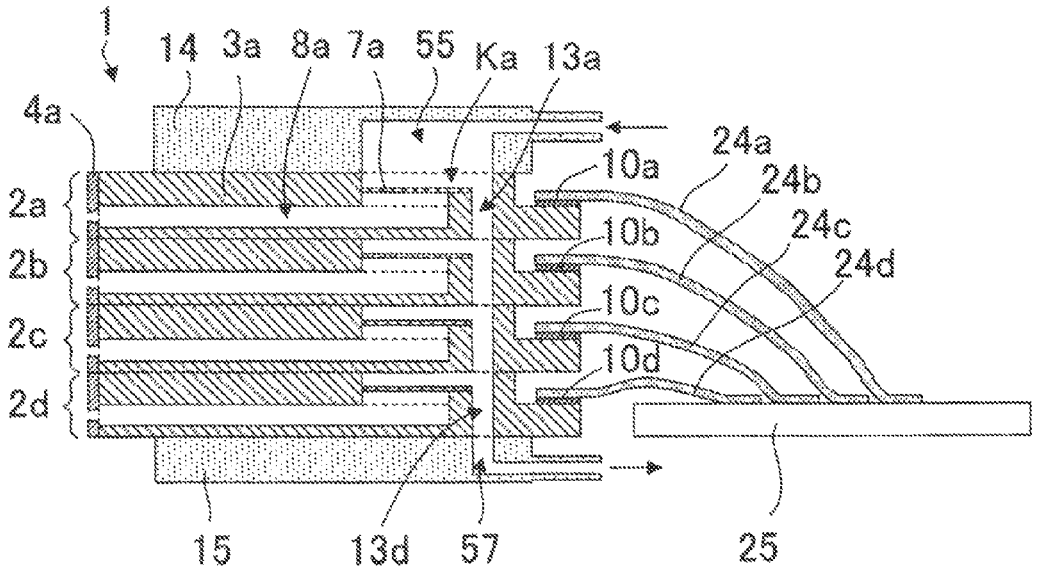
FIG. 2 is a conceptual view illustrating a structure of the liquid jet head according to the present invention.

FIG. 2 is a conceptual view illustrating a structure of the liquid jet head 1 according to the present invention, in which four head chips 2*a* to 2*d* are laminated. The head chips 2*a* to 2*d* have the same structure as that of the head chip 2*a* illustrated in FIG. 1, and are fixed to one another via an adhesive or a rubber sealing material therebetween. An upper end flow path member 14 is provided on the head chip 2*a* in the uppermost layer. The upper end flow path member 14 includes a first supply path 55 communicating to an upstream side of the filter 7*a* and with the communication path 13*a*. A lower end flow path member 15 is provided under the head chip 2*d* in the lowermost layer. The lower end flow path member 15 includes a first discharge path 57 communicating to a communication path 13*d*. Further, the electrode terminal 10*a* of the head chip 2*a* and a circuit board 25 are connected via the FPC 24*a*. Similarly, electrode terminals 10*b* to 10*d* of the head chips 2*b* to 2*d* and the circuit board 25 are connected via FPCs 24*b* to 24*d*, respectively.

This causes part of liquid supplied to the first supply path 55 in the upper end flow path member 14 to flow through the filter 7*a* via the opening Ka of the head chip 2*a* and further to be filled into the channel 8*a*, and causes the rest of the liquid to flow into the communication path 13*a* and then sequentially into the channels and the communication paths in the head chips 2*b* to 2*d*. Further, the liquid flows from the communication path 13*d* into the first discharge path 57 in the lower end flow path member 15 to be discharged to the outside.

It is noted that in FIG. 2, the upper end flow path member 14 is provided on the head chip 2*a* in the uppermost layer and the lower end flow path member 15 is provided under the head chip 2*d* in the lowermost layer, but the present invention is not limited thereto. A plurality of communication paths 13 for an inflow of liquid and for an outflow of liquid may be formed in each of the head chips 2*a* to 2*d*, and a supply path for liquid supply and a discharge path for liquid discharge may be formed in the upper end flow path member 14 provided on the head chip 2*a*, so that the supply path may communicate to the communication path for an inflow of liquid in the head chip 2*a* and with the upstream side of the filter 7*a* and the discharge path may communicate to the communication path for an outflow of liquid in the head chip 2*a*. Further, a flow path member for supplying and discharging liquid may be bonded to a side end face of each of the head chips 2*a* to 2*d* so that liquid may flow into and out of the head chips 2*a* to 2*d* sideways.

In this way, the head chips 2*a* to 2*d* in a large number of layers are laminated together, and thus, the recording density of liquid droplets ejected from the nozzles can be improved. Further, the four head chips 2*a* to 2*d* can be manufactured through the same manufacturing process steps. Each of the head chips 2*a* to 2*d* includes the filter, and thus, a foreign matter such as dust can be prevented from entering the respective channels during manufacture. Further, the nozzle plates are provided on the first end faces of the actuator portions, respectively, and thus, ejection inspection can be carried out in advance before the head chips 2*a* to 2*d* are laminated and bonded together. In other words, only the head chips 2*a* to 2*d* which have passed the ejection inspection can be assembled. Therefore, compared with a case in which inspection is carried out after assembly, manufacturing yield can be improved to reduce costs.

(First Embodiment)

Figure 3A:
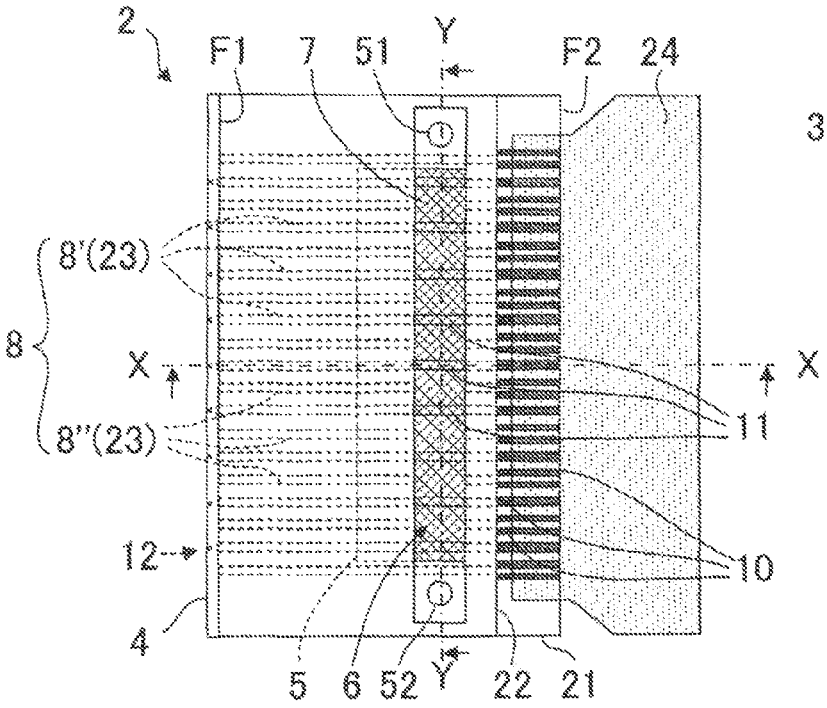
FIGS. 3A to 3C are explanatory views of a head chip according to a first embodiment of the present invention.
Figure 3B:
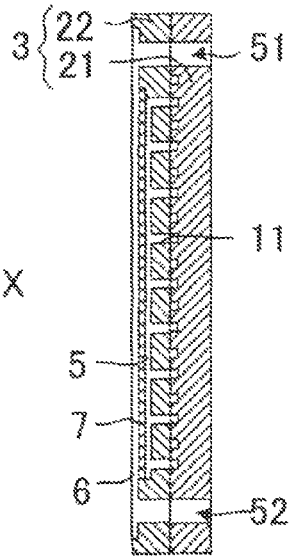
Figure 3C:
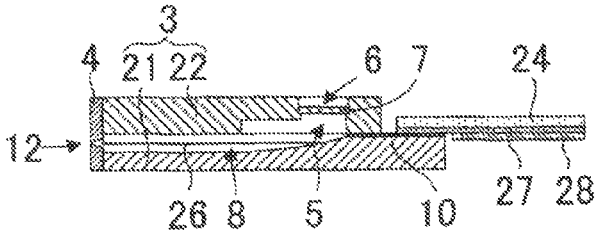
Figure 4:
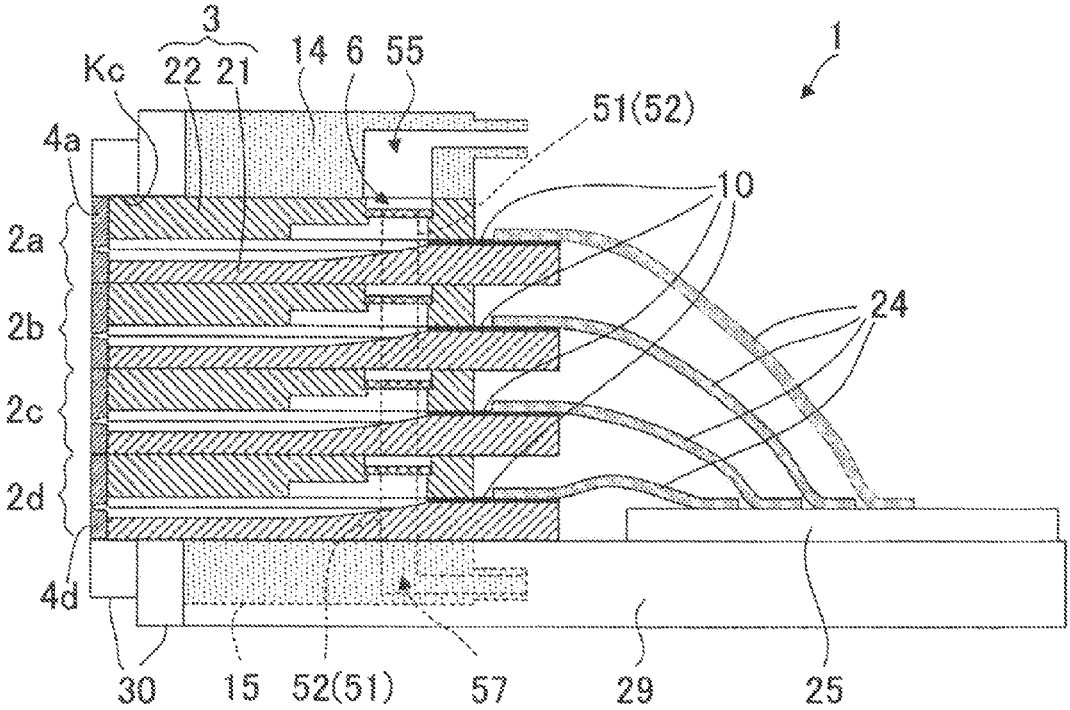
FIG. 4 is a schematic sectional view of a liquid jet head according to the first embodiment of the present invention.
Figure 5:
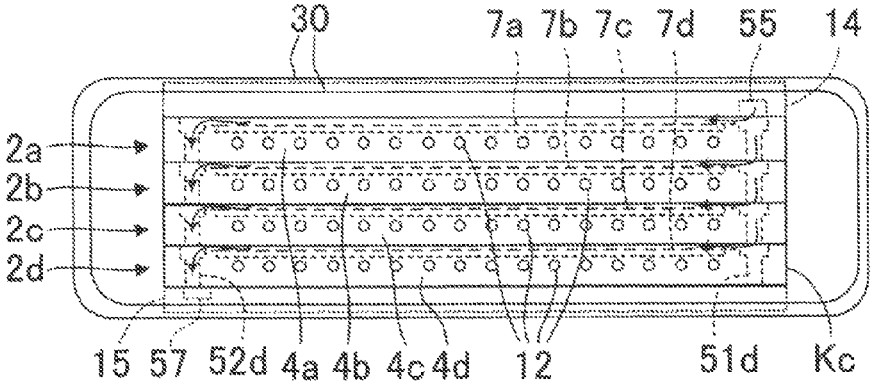
FIG. 5 is a schematic front view of the liquid jet head according to the first embodiment of the present invention as seen from an ejection surface side.

FIGS. 3A to 3C, FIG. 4, and FIG. 5 are explanatory views of the liquid jet head 1 according to a first embodiment of the present invention. FIGS. 3A to 3C are explanatory views of a head chip 2. FIG. 3A is a schematic plan view of the head chip 2, FIG. 3B is a schematic sectional view taken along the line Y-Y of FIG. 3A, and FIG. 3C is a schematic sectional view taken along the line X-X of FIG. 3A. FIG. 4 is a schematic sectional view of the liquid jet head 1. FIG. 5 is a schematic front view of the liquid jet head 1 as seen from an ejection surface side. Note that, throughout the figures, the same parts or parts having the same functions are denoted by the same reference symbols.

As illustrated in FIGS. 3A to 3C, an actuator portion 3 includes a piezoelectric substrate 21 formed of a piezoelectric material and a cover plate 22 bonded to a surface of the piezoelectric substrate 21. A plurality of grooves 23 in parallel with one another are formed in the surface of the piezoelectric substrate 21 so as to extend from a first end face F1 which is one end portion to the vicinity of a second end face F2 which is the other end portion on the opposite side. A plurality of electrode terminals 10 are formed on the surface of the piezoelectric substrate 21 on the second end face F2 side correspondingly to the plurality of grooves 23. Channels 8 are formed by the grooves 23 formed in the piezoelectric substrate 21 and the cover plate 22 which covers upper openings of the grooves 23.

A filter 7 is provided in the cover plate 22. A second liquid chamber 6 is provided on a liquid inflow side of the filter 7, and a first liquid chamber 5 is provided on a liquid outflow side of the filter 7. The cover plate 22 is bonded to the surface of the piezoelectric substrate 21 so as to cover the plurality of grooves 23 and so as to expose the plurality of electrode terminals 10. A nozzle plate 4 is bonded to the first end face F1 of the piezoelectric substrate 21 and to an end face of the cover plate 22 which is formed so as to be flush with the first end face F1. An FPC 24 is bonded to the surface of the piezoelectric substrate 21 in vicinity of the second end face F2. A plurality of wirings 27 formed on a surface of the FPC 24 are electrically conductive to the plurality of electrode terminals 10 formed on the surface of the piezoelectric substrate 21. The wirings 27 on the FPC 24 are covered by a protective film 28 except for bonded portions.

The channels 8 include ejection channels 8' which eject liquid and dummy channels 8" which do not eject liquid. The ejection channels 8' and the dummy channels 8" are alternately arranged so as to be in parallel with one another. The plurality of ejection channels 8' which eject liquid form a channel row in which the plurality of ejection channels 8' are arranged in a short side direction of the ejection channels 8'. A plurality of slits 11 communicating to the first liquid chamber 5 are formed in the cover plate 22. Each slit 11 communicates to the ejection channel 8' and does not communicate to the dummy channel 8". Therefore, liquid flows into the ejection channels 8' but does not flow into the dummy channels 8".

The first liquid chamber 5 communicates to the plurality of ejection channels 8' which form the channel row. Communication paths include a first communication path 51 provided in vicinity of one end portion of the first liquid chamber 5 in the direction of arrangement of the ejection channels 8', and a second communication path 52 provided in vicinity of the other end portion. The two first and second communication paths 51 and 52 pass from the second liquid chamber 6 through the cover plate 22 and the piezoelectric substrate 21 and are open to a surface of the head chip 2 which is opposite to the filter 7 side.

Drive electrodes 26 are formed on side walls forming the channels 8. The drive electrodes 26 apply an electric field in a thickness direction of the side walls. The drive electrodes 26 on the side walls are electrically conductive to the electrode terminals 10. The side walls of the channels 8 are formed of a piezoelectric material, and are in advance subjected to polarization processing in a direction of the upright side walls. Liquid supplied to the second liquid chamber 6 flows through the filter 7 into the first liquid chamber 5, and further, is filled via the slits 11 into the plurality of ejection channels 8'. When a drive signal is applied to an electrode terminal 10, the side walls thereof are deformed in the shape of "V" set on its side from the upright state (thickness shear deformation). This induces pressure on liquid which is filled into the ejection channel 8', and a liquid droplet is ejected from a nozzle 12 communicating to the ejection channel 8'.

As illustrated in FIG. 4, the four head chips 2*a* to 2*d* are bonded together via an adhesive so that the surfaces of the nozzle plates 4 thereof are flush with one another. In this case, the first and second communication paths 51 and 52 in the actuator portion 3 in an upper layer communicate to the first communication path 51 and the second liquid chamber 6, and the second communication path 52 and the second liquid chamber 6, respectively, in the actuator portion 3 in a lower layer. Further, the upper end flow path member 14 is provided on the head chip 2*a* in the uppermost layer, and the lower end flow path member 15 is provided under the head chip 2*d* in the lowermost layer. The upper end flow path member 14 has the first supply path 55 therein, and is bonded via an adhesive to an upper surface of the head chip 2*a* so that the first supply path 55 communicates to the second liquid chamber 6 in the head chip 2*a*. The lower end flow path member 15 has the first discharge path 57 therein, and is bonded via an adhesive to a lower surface of the head chip 2*d* so that the first discharge path 57 communicates to the second communication path 52 in the head chip 2*d*.

A laminate of the four head chips 2*a* to 2*d*, the upper end flow path member 14, and the lower end flow path member 15 is inserted into an opening Kc in the center of a frame 30 so that the surfaces of the nozzle plates 4*a* to 4*d* are exposed, and is fixed to a base substrate 29. The circuit board 25 is provided on the base substrate 29, and the circuit board 25 and the electrode terminals 10 provided on the head chips 2*a* to 2*d* are electrically connected via the FPCs 24.

As illustrated in FIG. 5, an ejection surface of the liquid jet head 1 is formed of the nozzle plates 4*a* to 4*d* provided for the head chips 2*a* to 2*d*, respectively. The plurality of nozzles 12 are open in the nozzle plates 4*a* to 4*d*. As illustrated by arrows, liquid which flows from the first supply path 55 in the upper end flow path member 14 flows into the first communication path 51 and the second liquid chamber 6 of each of the head chips 2*a* to 2*d*, and flows in the second liquid chamber 6 from the first communication path 51 side to the second communication path 52 side. Then, the liquid collects in a second communication path 52*d* in the head chip 2*d* in the lowermost layer, and is discharged from the first discharge path 57 in the lower end flow path member 15. Therefore, fresh liquid is always supplied to the respective nozzles 12. Note that, the nozzles 12 in the nozzle plates 4*a* to 4*d* may be shifted by ¼ or ½ of a pitch in a direction of the nozzle row in which the plurality of nozzles 12 are arranged to improve the recording density.

Figure 13:
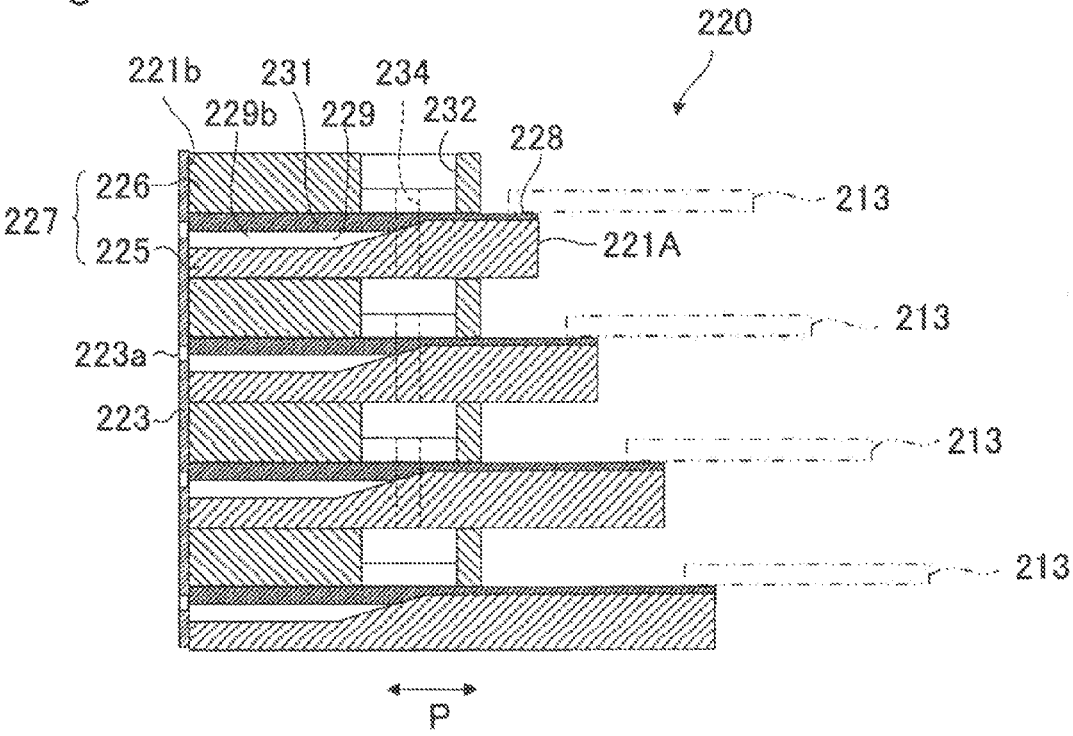
FIG. 13 is a schematic sectional view of another conventionally known liquid jet head.

As described above, the four head chips 2*a* to 2*d* have the same structure. Therefore, the head chips 2*a* to 2*d* can be manufactured through the same manufacturing process steps. Further, the head chips 2*a* to 2*d* include the nozzle plates 4*a* to 4*d* and the filters 7*a* to 7*d*, respectively. Therefore, a foreign matter such as dust can be prevented from entering the respective channels 8 in a step of bonding the FPC 24 to each of the head chips 2*a* to 2*d*, a bonding step of laminating and bonding the head chips 2*a* to 2*d*, and a step of providing the upper end flow path member 14 and the lower end flow path member 15. Further, ejection inspection can be carried out in advance before the head chips 2*a* to 2*d* are laminated and bonded together, and thus, the manufacturing yield can be improved. Further, when any one of the head chips 2 is out of order, only the head chip 2 which is out of order can be replaced, and thus, maintenance can be performed easily and at low cost. Further, compared with the conventional liquid jet head 220 illustrated in FIG. 13, a head chip body does not protrude backward by a large amount from a head chip body immediately thereon, and thus, materials such as the piezoelectric material can be reduced and a lightweight and compact structure can be formed.

It is noted that in the above-mentioned embodiment, the head chips 2 are described in which ejection operation is carried out in one cycle drive under a state in which the ejection channels 8' and the dummy channels 8" are alternately arranged, but the present invention is not limited thereto. The head chips 2 may carry out ejection operation in three cycle drive under a state in which all the channels 8 are ejection channels. Further, in the above-mentioned embodiment, a piezoelectric material is used for the piezoelectric substrate 21 forming the actuator portion 3, but instead, only the side walls of the grooves 23 may be formed of a piezoelectric material, and a substrate formed of an insulating material may be used for the remaining portions of the piezoelectric substrate 21. Further, the grooves 23 formed in the actuator portion 3 may be straight from the first end face F1 to the second end face F2, and the grooves 23 on the second end face F2 side of the first liquid chamber 5 may be sealed by a sealing material so that liquid does not leak to the outside.

(Second Embodiment)

Figure 6:
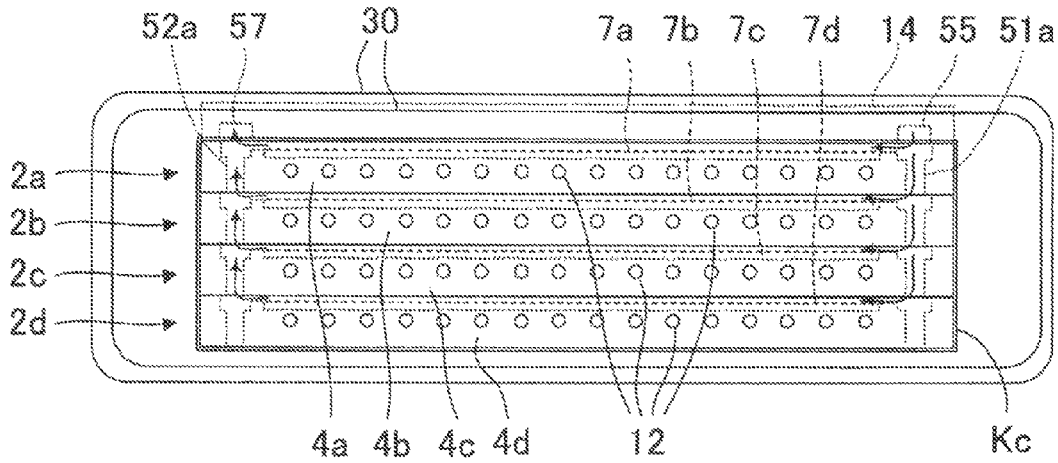
FIG. 6 is a schematic front view of a liquid jet head according to a second embodiment of the present invention as seen from the ejection surface side.

FIG. 6 is a schematic front view of the liquid jet head 1 according to a second embodiment of the present invention as seen from the ejection surface side. This embodiment is different from the first embodiment in that liquid is supplied and discharged using the upper end flow path member 14 and that the lower end flow path member 15 is eliminated. Except for those points, the structure is similar to that of the first embodiment, and thus, description thereof is omitted. The same parts or parts having the same functions are denoted by the same reference symbols.

As illustrated in FIG. 6, the upper end flow path member 14 is provided on the head chip 2*a* in the uppermost layer, and includes the first supply path 55 communicating to the upstream side of the filter 7*a* (second liquid chamber 6) and a first communication path 51*a*, and the first discharge path 57 communicating to a second communication path 52*a*. As illustrated by arrows, liquid flows from the first supply path 55 in the upper end flow path member 14 into the second liquid chamber 6 and the first communication path 51*a* in the head chip 2*a*, and further, flows from the first communication path 51*a* sequentially into the second liquid chambers 6 and the first communication paths 51 in the head chips 2*b* to 2*d* in the lower layers, respectively. Liquid flows in the second liquid chambers 6 from one end portions to the other end portions of the head chips 2*a* to 2*d*, respectively, flows into the second communication paths 52 in the head chips 2*a* to 2*d*, respectively, and is discharged from the first discharge path 57 in the upper end flow path member 14.

As described above, the lower end flow path member 15 can be eliminated, and thus, the volume and the weight of the liquid jet head 1 can be reduced. Note that, in FIG. 6, the lower end flow path member 15 may be provided under the head chip 2 in the lowermost layer, and liquid may be caused to flow from the first communication path 51 to the second communication path 52 in the head chip 2*d* to eliminate a place at which liquid is held up. Further, the first communication path 51 and the second communication path 52 may be removed from the head chip 2*d* in the lowermost layer, and all the liquid which flows from the first communication path 51 in the head chip 2*c* may be introduced into the second liquid chamber 6 in the head chip 2*d*. Liquid which flows out of the second liquid chamber 6 may be introduced into the second communication path 52 in the head chip 2*c*.

(Third Embodiment)

Figure 7:
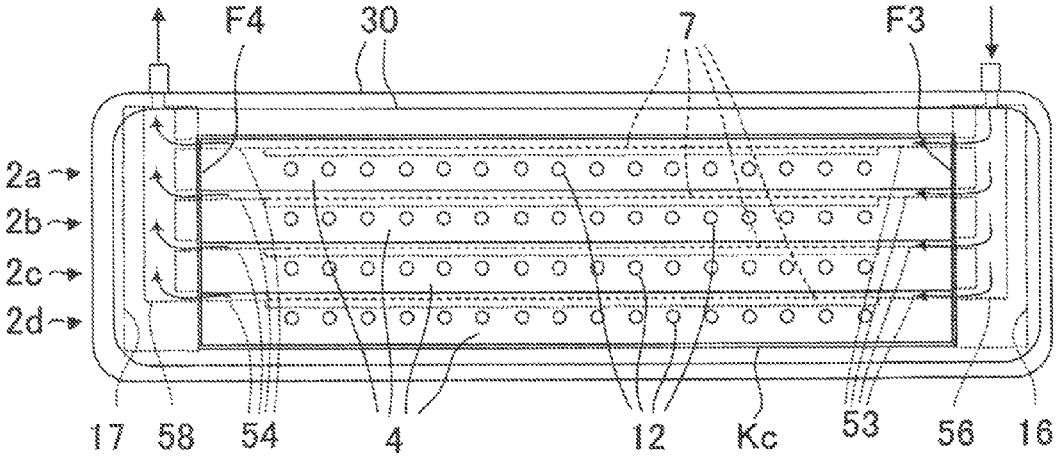
FIG. 7 is a schematic front view of a liquid jet head according to a third embodiment of the present invention as seen from the ejection surface side.

FIG. 7 is a schematic front view of the liquid jet head 1 according to a third embodiment of the present invention as seen from the ejection surface side. This embodiment is different from the first embodiment in that, instead of the upper end flow path member 14 and the lower end flow path member 15, a right end flow path member 16 is provided along a third end face F3 which is right side surfaces of the head chips 2*a* to 2*d*, and a left end flow path member 17 is provided along a fourth end face F4 which is left side surfaces of the head chips 2*a* to 2*d*. In the following, parts different from those in the first embodiment are mainly described, and description of the same parts is omitted. The same parts or parts having the same functions are denoted by the same reference symbols. Note that, in the following description, "right" and "left" refer to one side and the other side, respectively, of the two side surfaces in the direction of the channel row in the actuator portion 3, and are not limited to right and left as seen from a specific angle.

As illustrated in FIG. 7, the right end flow path member 16 is provided along the third end face F3 of the head chips 2*a* to 2*d*, and communicates to the upstream sides of the filters 7 (second liquid chambers 6) and third communication paths 53 in the head chips 2*a* to 2*d*. Further, the left end flow path member 17 is provided along the fourth end face F4 of the head chips 2*a* to 2*d*, and communicates to the upstream sides of the filters 7 and fourth communication paths 54 in the head chips 2*a* to 2*d*.

In this case, the third communication paths 53 and the fourth communication paths 54 in the head chips 2*a* to 2*d* are provided in surfaces of the cover plates 22 (see FIG. 4) forming the actuator portions 3. As illustrated by arrows, liquid supplied to the right end flow path member 16 flows from a second supply path 56 into the third communication paths 53 and the second liquid chambers 6 in the head chips 2*a* to 2*d*, flows from the third communication path 53 side to the fourth communication path 54 side, and flows via the fourth communication paths 54 into a second discharge path 58 to be discharged.

It is noted that in FIG. 7, liquid flows from the second supply path 56 via the third communication paths 53 into the head chips 2*a* to 2*d*, and liquid flows via the fourth communication paths 54 in the head chips 2*a* to 2*d* into the second discharge path 58. Instead of this, as in the second embodiment, the third communication paths 53 in the head chips 2*a* to 2*d* may be formed so as to communicate to each other between a head chip 2 in an upper layer and a head chip 2 in a lower layer. Similarly, the fourth communication paths 54 may be formed so as to communicate to each other between the head chips 2 in upper and lower layers. The second supply path 56 of the right end flow path member 16 may communicate to the third communication path 53 in the head chip 2*a*, and the second discharge path 58 of the left end flow path member 17 may communicate to the fourth communication path 54 in the head chip 2*d*. This enables an inflow of liquid from and an outflow of liquid to a direction orthogonal to the direction of ejection of liquid droplets.

(Fourth Embodiment)

Figure 8:
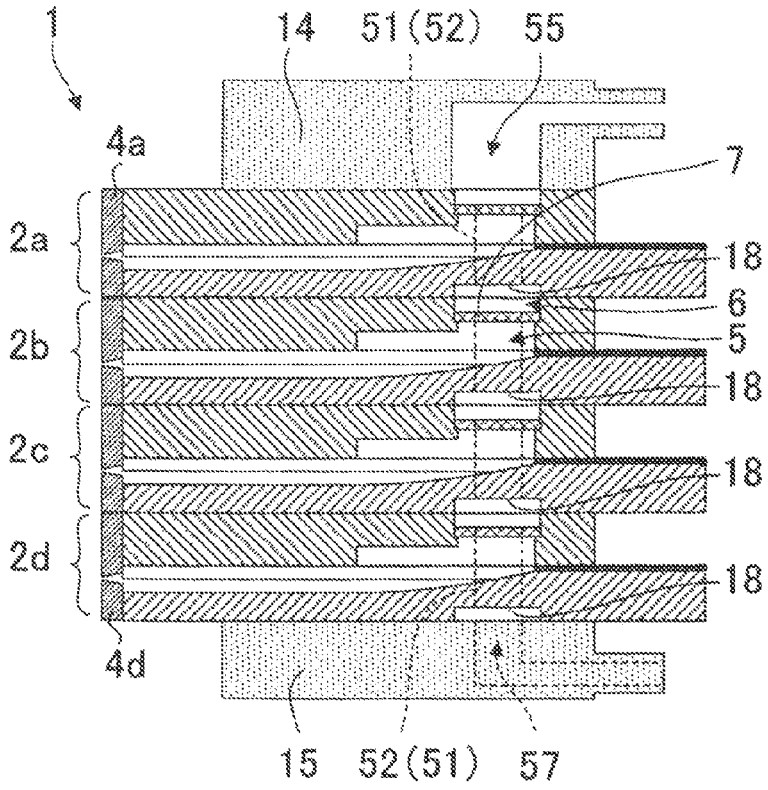
FIG. 8 is a schematic sectional view of a liquid jet head according to a fourth embodiment of the present invention.

FIG. 8 is a schematic sectional view of the liquid jet head 1 according to a fourth embodiment of the present invention. In FIG. 8, the frame, the base substrate, the circuit board, and the FPC are omitted. The same parts or parts having the same functions are denoted by the same reference symbols. This embodiment is different from the first embodiment in that a recessed portion 18 is formed in a region in the head chip 2 in an upper layer corresponding to the filter 7 of the head chip 2 in a lower layer. Except for this point, this embodiment is similar to the first embodiment. In the following, parts different from those in the first embodiment are described, and description of the same parts is omitted.

As illustrated in FIG. 8, in the liquid jet head 1, the four head chips 2*a* to 2*d* are laminated so that the surfaces of the nozzle plates 4*a* to 4*d* thereof are flush with one another. The upper end flow path member 14 is provided on the head chip 2*a* in the uppermost layer, and the lower end flow path member 15 is provided under the head chip 2*d* in the lowermost layer. The head chip 2 in an upper layer has the recessed portion 18 in the region corresponding to the filter 7 of the head chip 2 in a lower layer, and the first communication path 51 (second communication path 52) in the head chip 2 in an upper layer is open in a bottom surface of the recessed portion 18. Specifically, the second liquid chamber 6 provided on the upstream side of the filter 7 in a lower layer is enlarged by the recessed portion 18 in the head chip 2 in an upper layer. By the addition of the region of the recessed portion 18 to the second liquid chamber 6, liquid which flows into the second liquid chamber 6 is more easily to pass through the entire effective surface of the filter 7, which reduces pressure loss by the filter 7.

(Fifth Embodiment)

Figure 9:
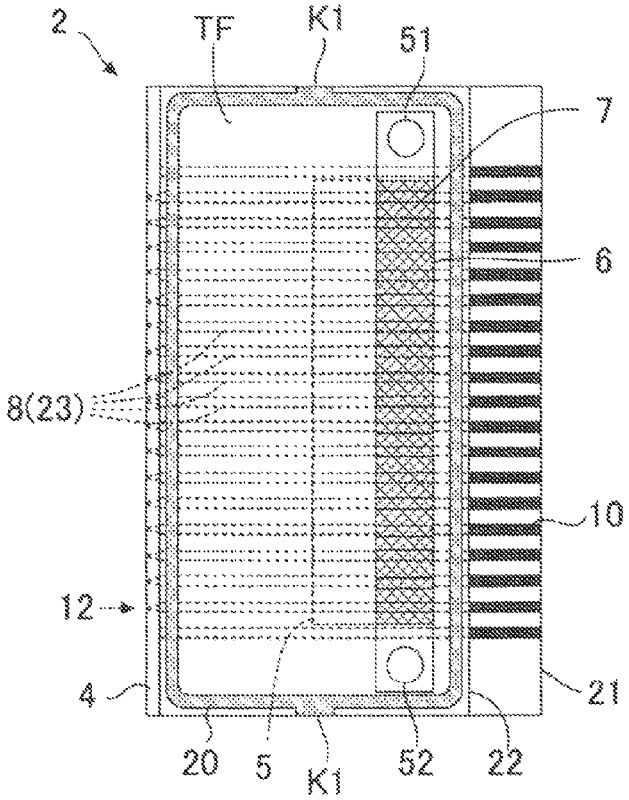
FIG. 9 is a schematic top view of a head chip according to a fifth embodiment of the present invention.

FIG. 9 is a schematic top view of the head chip 2 of the liquid jet head 1 according to a fifth embodiment of the present invention. The same parts or parts having the same functions are denoted by the same reference symbols. The head chip 2 of this embodiment is different from the head chip 2 in the first embodiment in that there is a bonding groove 20 in vicinity of an outer perimeter of an upper end face TF of the head chip 2, that all the grooves 23 formed in the surface of the piezoelectric substrate 21 form the channels 8 which can eject a liquid droplet except the grooves 23 at both ends, and that the first liquid chamber 5 does not include slits but communicates to all the grooves 23 except the grooves 23 at both ends. In the following, points different from those in the first embodiment are described, and description of the same parts is omitted.

As illustrated in FIG. 9, the head chip 2 includes the bonding groove 20 for introducing an adhesive in the upper end face TF thereof, that is, in the upper end face TF of the cover plate 22 forming the head chip 2. The bonding groove 20 is provided along the outer perimeter of the cover plate 22 so as to surround the opening of the second liquid chamber 6, which is open in the upper end face TF of the cover plate 22. The bonding groove 20 includes two openings K1, which are open in side surfaces in the direction of arrangement of the plurality of channels 8. By laminating the head chip 2 in an upper layer onto the head chip 2 in a lower layer and introducing the adhesive through the openings K1, the head chips 2 in the upper and lower layers can be bonded together.

It is noted that in this embodiment, the ejection operation can be carried out in three cycle drive. Further, in this embodiment, the bonding groove 20 is provided in the upper end face TF of the head chip 2, but, instead thereof, or in addition thereto, the bonding groove 20 may be provided in a lower end face of the head chip 2 (lower surface of the piezoelectric substrate 21).

(Sixth Embodiment)

Figure 10:
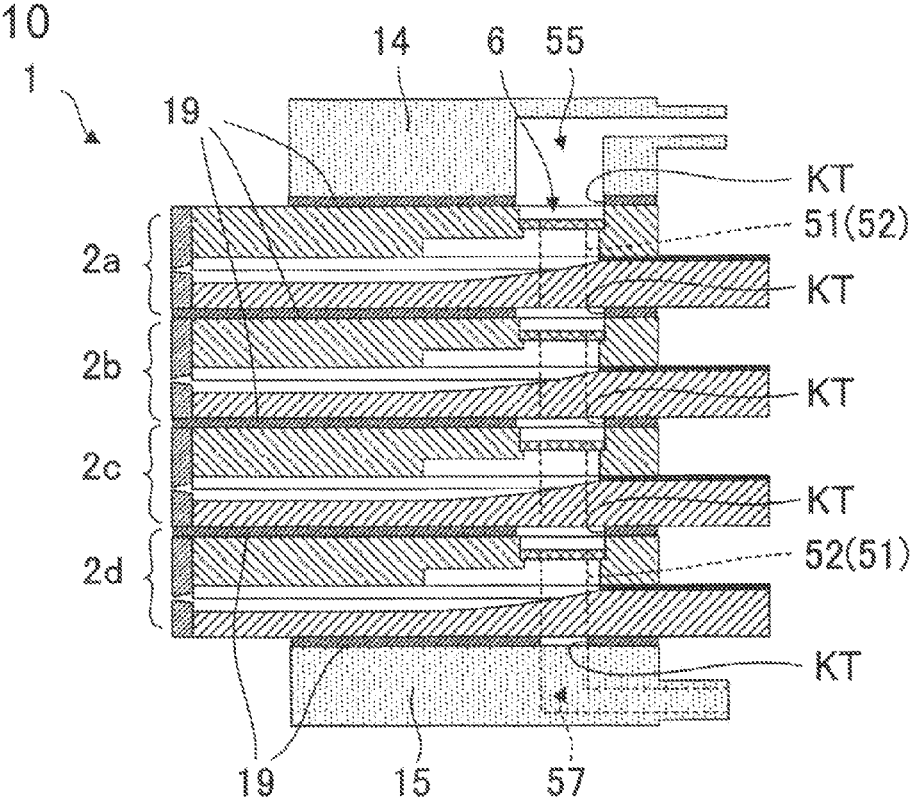
FIG. 10 is a schematic sectional view of a liquid jet head according to a sixth embodiment of the present invention.

FIG. 10 is a schematic sectional view of the liquid jet head 1 according to a sixth embodiment of the present invention. In FIG. 10, the frame, the base substrate, the circuit board, and the FPC are omitted. The same parts or parts having the same functions are denoted by the same reference symbols. This embodiment is different from the first embodiment in that the head chip 2 in an upper layer and the head chip 2 in a lower layer are laminated together via a rubber sealing material 19. Except for this point, the structure is similar to that of the first embodiment. In the following, parts different from those in the first embodiment are described, and description of the same parts is omitted.

As illustrated in FIG. 10, the head chip 2 in an upper layer and the head chip 2 in a lower layer are laminated together with the rubber sealing material 19 sandwiched therebetween. The rubber sealing material 19 includes a through hole KT at a place in which the first communication path 51 (second communication path 52) in the head chip 2 in an upper layer is open, and in a region in which the second liquid chamber 6 in the head chip 2 in a lower layer is open. Further, the upper end flow path member 14 is provided on the head chip 2*a* in the uppermost layer and the lower end flow path member 15 is provided under the head chip 2*d* in the lowermost layer both via the rubber sealing material 19. The rubber sealing material 19 provided between the head chip 2*a* in the uppermost layer and the upper end flow path member 14 includes the through hole KT correspondingly to the region in which the first supply path 55 formed in the upper end flow path member 14 is open and the region in which the second liquid chamber 6 in the head chip 2*a* in the uppermost layer is open. Similarly, the rubber sealing material 19 between the head chip 2*d* in the lowermost layer and the lower end flow path member 15 also includes the through hole KT. By providing the rubber sealing material 19 between the head chips 2*a* to 2*d*, between the upper end flow path member 14 and the head chip, and between the lower end flow path member 15 and the head chip, the liquid jet head 1 can be disassembled easily and assembled easily in maintenance.

(Seventh Embodiment)

Figure 11:
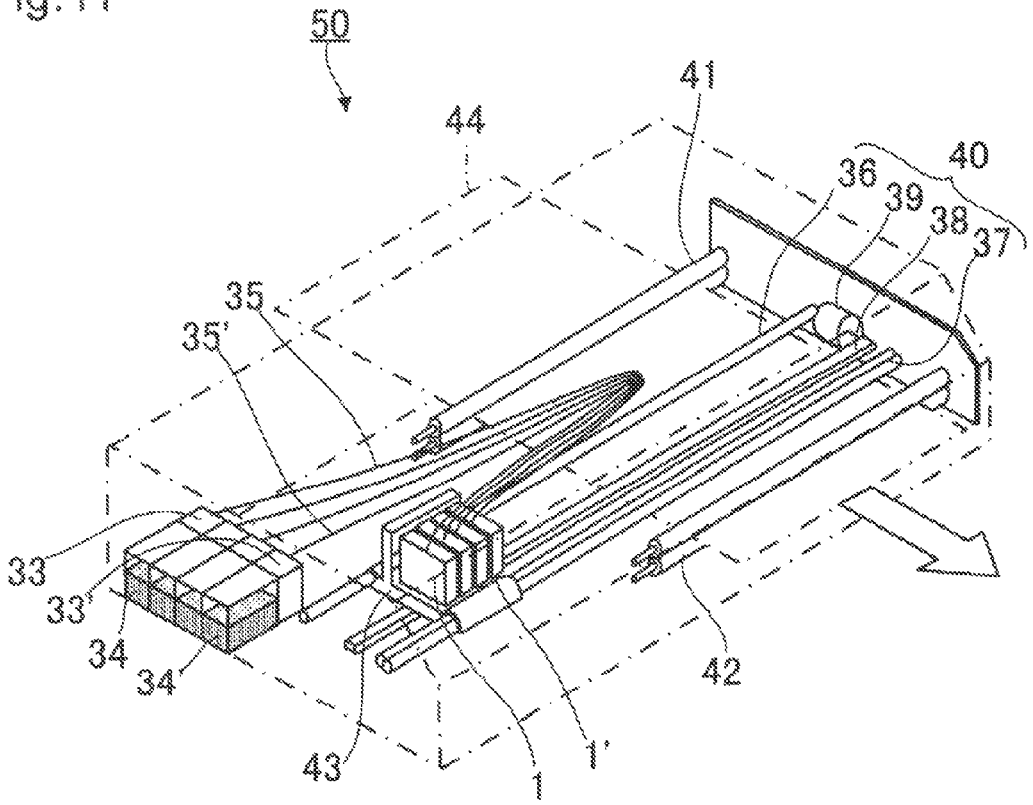
FIG. 11 is a schematic perspective view of a liquid jet apparatus according to a seventh embodiment of the present invention.
Figure 12:
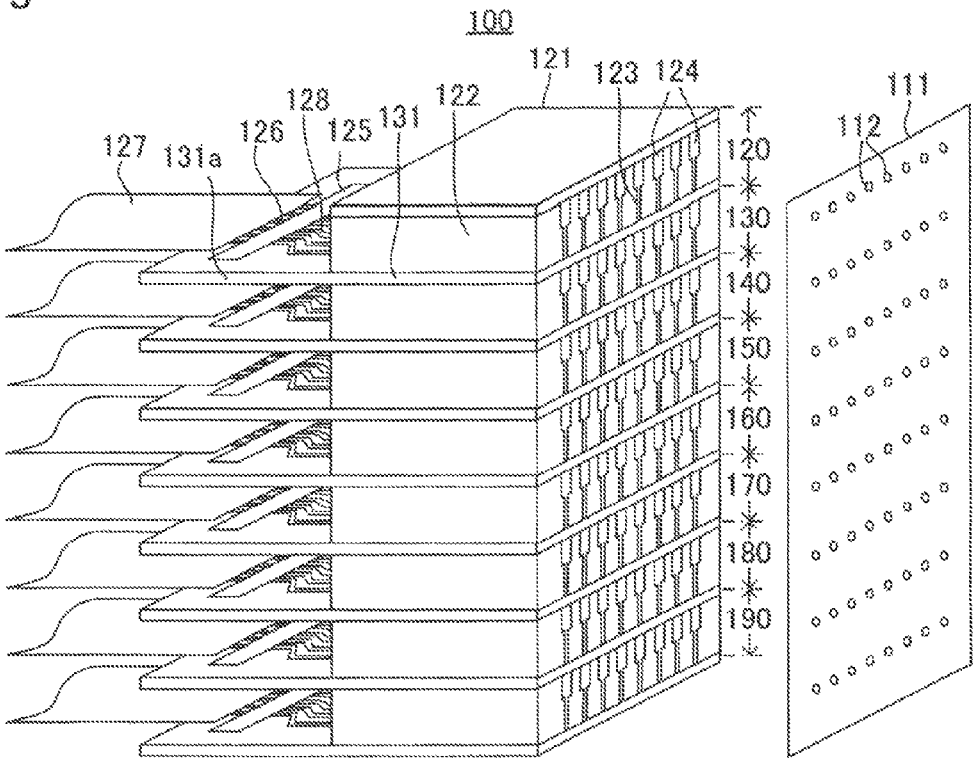
FIG. 12 is a schematic view of a conventionally known ink jet head.

FIG. 11 is a schematic perspective view of a liquid jet apparatus 50 according to a seventh embodiment of the present invention. The liquid jet apparatus 50 includes a moving mechanism 40 for reciprocating liquid jet heads 1 and 1', flow path portions 35 and 35' for supplying liquid to the liquid jet heads 1 and 1' and discharging the liquid from the liquid jet heads 1 and 1', and liquid pumps 33 and 33' and liquid tanks 34 and 34' for supplying liquid to the flow path portions 35 and 35'. Each of the liquid jet heads 1 and 1' includes a plurality of head chips. Each of the head chips includes a plurality of channels, and ejects a liquid droplet through a nozzle which communicates to each of the channels. As the liquid jet heads 1 and 1', any ones of the liquid jet heads of the first to sixth embodiments described above are used.

The liquid jet apparatus 50 includes a pair of conveyance means 41 and 42 for conveying a recording medium 44 such as paper in a main scanning direction, the liquid jet heads 1 and 1' for ejecting liquid toward the recording medium 44, a carriage unit 43 for mounting thereon the liquid jet heads 1 and 1', the liquid pumps 33 and 33' for pressurizing liquid stored in the liquid tanks 34 and 34' to be supplied to the flow path portions 35 and 35', and the moving mechanism 40 for causing the liquid jet heads 1 and 1' to scan in a sub-scanning direction which is orthogonal to the main scanning direction. A control portion (not shown) controls and drives the liquid jet heads 1 and 1', the moving mechanism 40, and the conveyance means 41 and 42.

Each of the pair of conveyance means 41 and 42 includes a grid roller and a pinch roller which extend in the sub-scanning direction and which rotate with roller surfaces thereof being in contact with each other. A motor (not shown) axially rotates the grid rollers and the pinch rollers to convey in the main scanning direction the recording medium 44 sandwiched therebetween. The moving mechanism 40 includes a pair of guide rails 36 and 37 which extends in the sub-scanning direction, the carriage unit 43 which is slidable along the pair of guide rails 36 and 37, an endless belt 38 which is coupled to the carriage unit 43 for moving the carriage unit 43 in the sub-scanning direction, and a motor 39 for rotating the endless belt 38 via a pulley (not shown).

The carriage unit 43 has the plurality of liquid jet heads 1 and 1' mounted thereon for ejecting, for example, four kinds of liquid droplets: yellow; magenta; cyan; and black. The liquid tanks 34 and 34' store liquid of corresponding colors, and supply the liquid via the liquid pumps 33 and 33' and the flow path portions 35 and 35' to the liquid jet heads 1 and 1'. The respective liquid jet heads 1 and 1' eject liquid droplets of the respective colors in accordance with a drive signal. Through control of ejection timings of liquid from the liquid jet heads 1 and 1', rotation of the motor 39 for driving the carriage unit 43, and conveyance speed of the recording medium 44, an arbitrary pattern may be recorded on the recording medium 44.

What is claimed is:

1. A liquid jet head having a plurality of head chips each comprising:

an actuator portion comprising:

a filter;

a first liquid chamber communicating to a downstream side of the filter;

a channel communicating to the first liquid chamber for inducing pressure on liquid therein; and an electrode terminal for transmitting a drive signal to the channel; and a nozzle plate bonded to a first end face of the actuator portion, the nozzle plate having a nozzle communicating to the channel;

wherein the plurality of head chips are laminated to form a laminated structure in which surfaces of the nozzle plates of the respective head chips are flush with one another, wherein the actuator portion of each head chip further comprises a communication path, and the communication path in the actuator portion in an upper layer of the laminated structure communicates to an upstream side of the filter and the communication path of the actuator portion in a lower layer of the laminated structure, wherein a plurality of the channels of the actuator portions are arranged to form a channel row, the first liquid chamber of each actuator portion communicates to the plurality of the channels forming the channel row, and the communication path of each actuator portion is provided in a vicinity of an end portion of the first liquid chamber in a direction of arrangement of the plurality of the channels forming the channel row, wherein the communication path of each actuator portion comprises a first communication path provided in a vicinity of one end portion of the first liquid chamber and a second communication path provided in a vicinity of another end portion of the first liquid chamber in the direction of arrangement of the plurality of the channels forming the channel row, and wherein the first communication path in the head chip in an upper layer of the laminated structure communicates to the first communication path and the upstream side of the filter of the head chip in a lower layer of the laminated structure, and the second communication path in the head chip in the upper layer of the laminated structure communicates to the second communication path and the upstream side of the filter of the head chip in the lower layer of the laminated structure.

2. A liquid jet head according to claim 1, further comprising an upper end flow path member provided on the head chip in an uppermost layer of the laminated structure and including a first supply path communicating to the upstream side of the filter and the first communication path.

3. A liquid jet head according to claim 1, further comprising a lower end flow path member provided under the head chip in a lowermost layer of the laminated structure and including a first discharge path communicating to the second communication path.

4. A liquid jet head according to claim 2, wherein the upper end flow path member comprises a first discharge path communicating to the second communication path.

5. A liquid jet head according to claim 4, wherein the communication path communicates to a second liquid chamber communicating to the upstream side of the filter.

* * * * *